United States Patent [19]

Bornancini

[11] 4,391,056

[45] Jul. 5, 1983

[54] RETAINING MEANS FOR REVOLVER CYLINDERS

[75] Inventor: Jose C. M. Bornancini, Porto Alegre, Brazil

[73] Assignee: Forjas Taurus S/A, Porto Alegre, Brazil

[21] Appl. No.: 219,433

[22] Filed: Dec. 23, 1980

[30] Foreign Application Priority Data

Dec. 27, 1979 [BR] Brazil ..... 7908530

[51] Int. Cl.[3] ..... F41C 1/00

[52] U.S. Cl. ..... 42/62

[58] Field of Search ..... 42/62, 65, 59

[56] References Cited

U.S. PATENT DOCUMENTS

| | | | |
|---|---|---|---|
| 3,221,433 | 12/1965 | Lewis | 42/62 |
| 3,628,278 | 12/1971 | Ruger | 42/62 |
| 3,685,193 | 8/1972 | Sefried | 42/62 |

*Primary Examiner*—Charles T. Jordan

*Attorney, Agent, or Firm*—Emory L. Groff, Jr.

[57] ABSTRACT

A retaining means for revolver cylinders includes a resilient bushing which, upon being inserted in the cylinder bore, is engaged in an annular recess in a hollow cylinder axle making it impossible to disengage the two parts from one another after introducing an extractor mechanism in the bushing and threadedly connecting a sleeve of the mechanism with the threaded end of the extractor rod.

5 Claims, 7 Drawing Figures

RETAINING MEANS FOR REVOLVER CYLINDERS

This invention relates to an improved means for retaining a revolver cylinder on the holder axle of revolvers of the kind which are loaded by a lateral tilting of the cylinder out of the opening in the revolver frame. Revolvers of this type have been known since the end of the last century. In this type of revolver, after lateral tilting of the cylinder, the extraction of the burned cartridges is made by pressing the extractor rod rearwardly. This rod, upon sliding within and along the cylinder axle, causes the extractor star member to move away from the back face of the cylinder, thus extracting the cartridges whose shoulders rest in the semicircular recesses of the star.

Extraction of the cartridges requires a translatory motion of the extractor and the star thereof in relation to the cylinder which must remain stationary which is due to the fact that the burned cartridges tend to adhere firmly to the walls of the cylinder chamber, in view of the expansion thereof.

The rearward displacement of the cylinder when open to permit the cartridge extraction operation, is prevented in the several known models of revolvers by projections, shoulders or abutment bushings on the cylinder. These solutions are either an integral part of the frame itself, which in inexpensive models, is made by an injection process of non-ferrous alloys or they are located in the side plate as is the case with revolvers such as Colt, High Standard and Dan Wesson. In the large majority of the cases however, they are formed by bushings secured to the frame as for example in Smith & Wesson, Charter Arms, Astra, Rossi, Llama, Manurhin and Taurus revolvers. These abutment bushings represent the more common solution in view of certain advantages in the manufacture and adjustment of such revolvers. However, the use thereof is not free of difficulties and drawbacks in manufacture as well as of problems in the utilization of the gun.

Among these drawbacks, are the large number of operations involved in the manufacturing process such as: drilling the bushing housing in the frame; reaming the bushing housing in the frame; placing and adjusting the bushing in the frame; milling the cylinder abutment in the bushing; removing the bushing of the frame prior to polishing; and adjusting again the bushing in the frame.

In addition, the following difficulties frequently occur: the possible loss of the bushings, since they are adjusted one at a time; the bad appearance of the bushing which is normally filed, in order to provide the same with a non-polished finish; problems of color difference of the bushing; and problems of oxidation around the bushing due to discontinuities relative to the frame.

During use of the gun, the following problems may occur: scratches in the cylinder due to rubbing with the bushing; eventual superimposition of the cartridge breeches on the bushing; and eventual passage of the cylinder over the bushing, in the case of improper readjustment thereof on the frame.

In order to avoid the abovementioned problems and drawbacks, the firm of Sturm Ruger and Co. of the United States, has developed in its "Security Six" model, a system for directly holding the cylinder on the axle of the tiltable holder. Thereby, the use of bushings etc., secured to the frame has been avoided. This system is based on the use of two small balls housed in the very thick axle of the cylinder holder. These balls have a certain radial play and when the extractor rod is inserted into the holder axle, it pushes the balls outwardly and they are then projected in relation to the holder axle into an annular recess existing in the front portion of the cylinder central bore. Thus, the cylinder is retained axially in relation to the holder axle but it can rotate freely thereabout.

Although interesting, this solution has some drawbacks, namely it depends on very close tolerances in relation to the diameter of the balls, the housing thereof, the annular recess of the cylinder, etc.; it can only be used in large revolvers such as the Security Six or the 357 Magnum, available from Sturm Ruger and Co., since it is of necessity a considerable thickness of the walls of the cylinder holder axle, to house the balls; it results in weakening of the inner portion of the cylinder chamber walls, which would be a critical feature in small revolvers or revolvers with powerful cartridges.

In view of the foregoing, studies have been performed to eliminate the use of the cylinder abutment bushing, which is secured to the frame, with the related problems and simultaneously obviate the drawbacks of the solution of Sturm Ruger and Co. previously discussed.

The results of these studies form the object of the present invention which provides a new system for the manufacture of the cylinder and of the respective cylinder holder in revolvers, so that the cylinder is retained on the holder axle by means of a novel constructional arrangement of the components forming part of the assembly comprising the holder, cylinder and extractor.

This retaining feature is independent of components such as bushings etc., secured to other assemblies, such as the frame, with the related submission to conditions of mutual dimensional tolerance.

Another object of the cylinder retaining means proposed above is to assure a perfect attachment of the cylinder in relation to the holder axle, even when the extractor rod is subjected to strong forces, in the case of difficult extraction due to jamming of the cartridges in the chambers.

Still another object of the present invention is that the cylinder retaining means can be fabricated by an easy and economical procedure.

A further object of this invention is the extreme versatility thereof and that it is applicable to large or small revolvers.

Another object is to obviate reduction of the cylinder strength, since the present invention does not require any recess or collar being made in the walls thereof, thus assuring maximum strength of the revolver's weakest component.

Finally, another object of the invention is to provide a cylinder retaining mechanism in which mounting and dismounting of the cylinder, holder, extractor assembly are substantially identical to those of known revolvers.

These and other objects and advantages of the present invention will be more readily apparent from the following disclosure of a preferred embodiment of the invention, when taken in conjunction with the accompanying drawings, in which.

Figure 1:
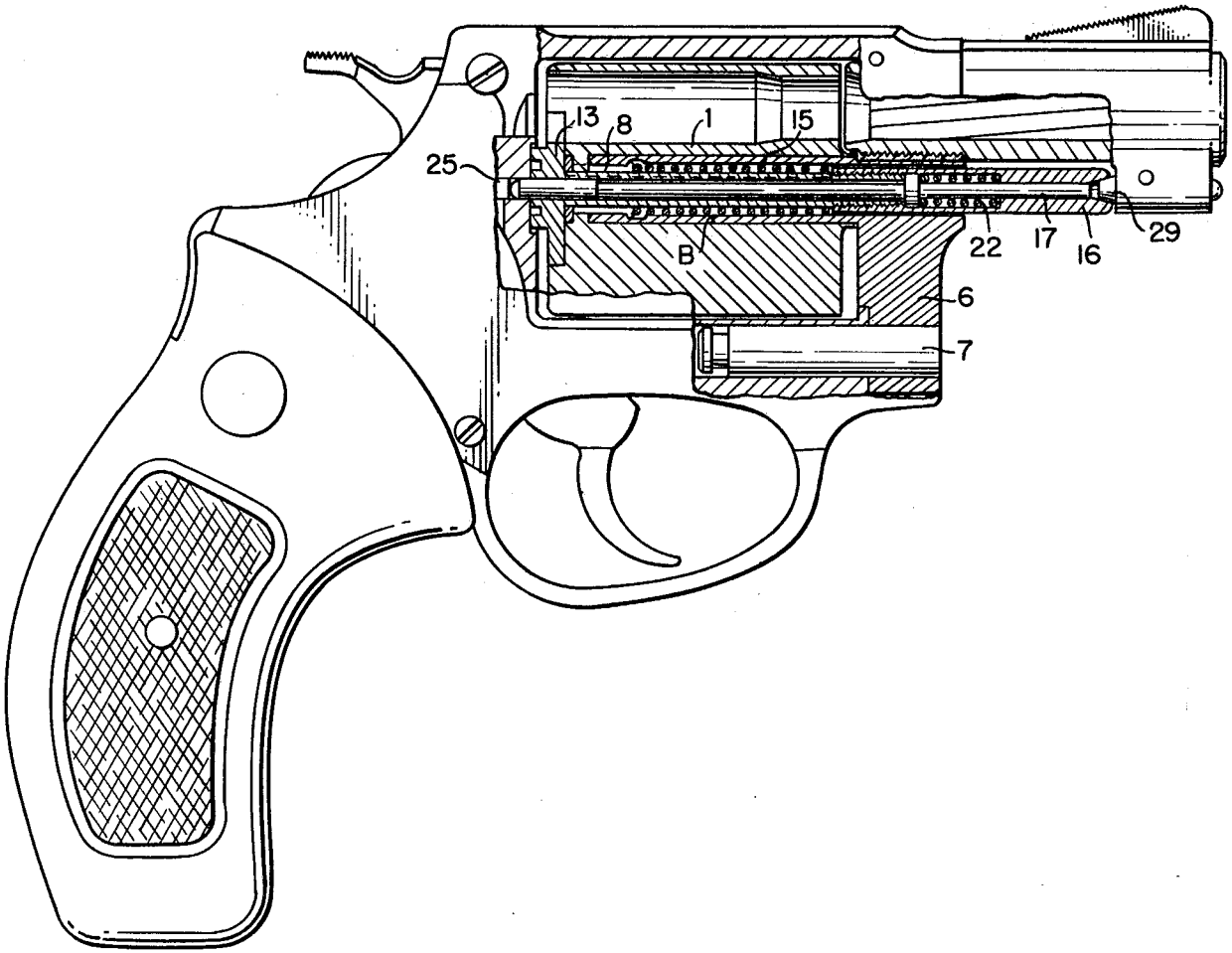
FIG. 1 is a side elevation, partly in section, of the revolver.
Figure 2:
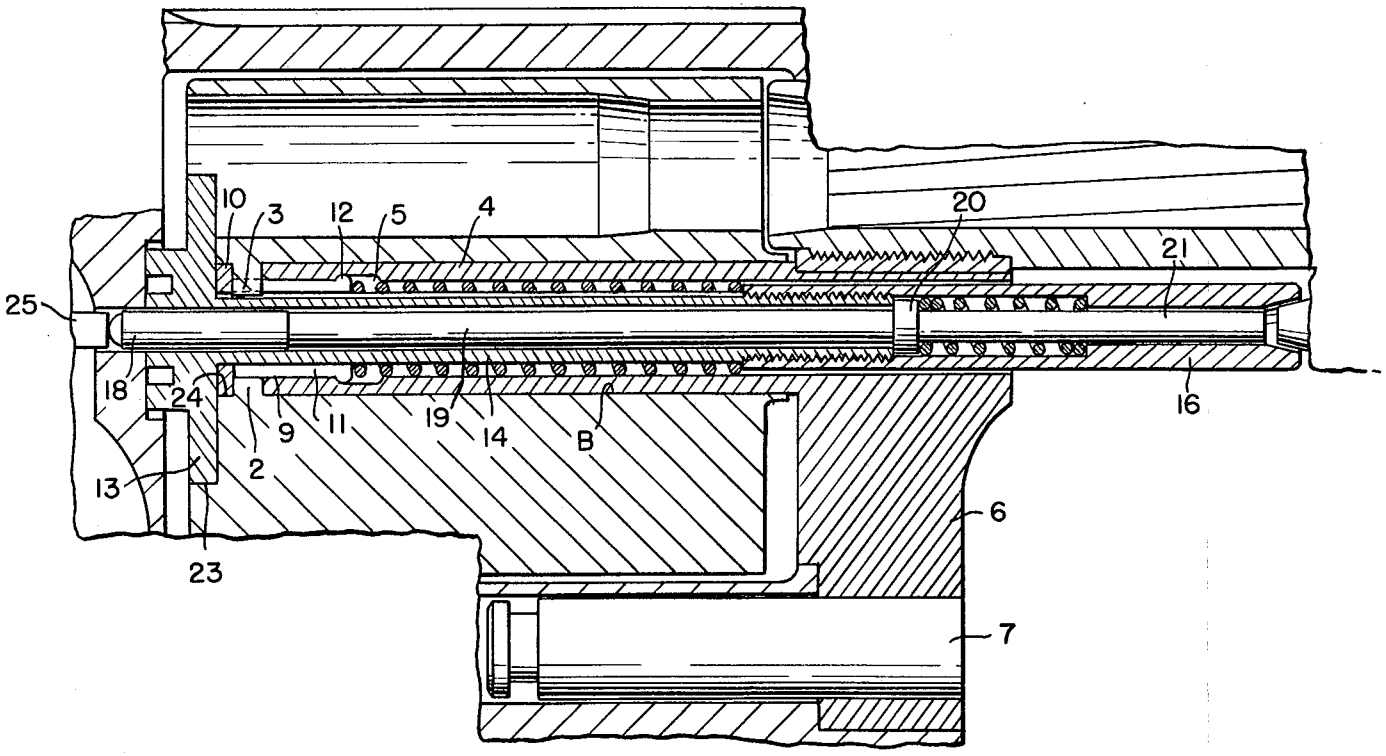
FIG. 2 is a sectional view of the assembly formed by the cylinder, cylinder holder, extractor, central rod and cylinder-holding bushing.
Figure 3:
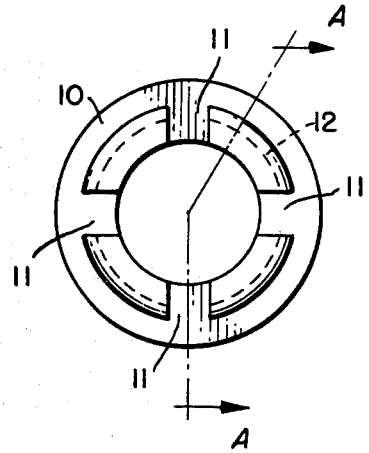
FIG. 3 is a front view of the cylinder holding bushing.
Figure 3A:
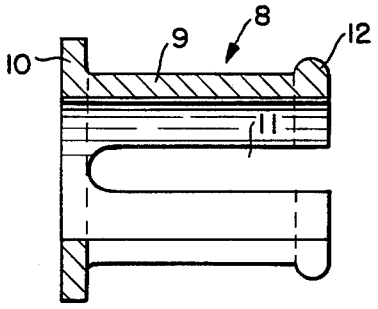
FIG. 3A is a side sectional view of the bushing of FIG. 3.
Figure 4:
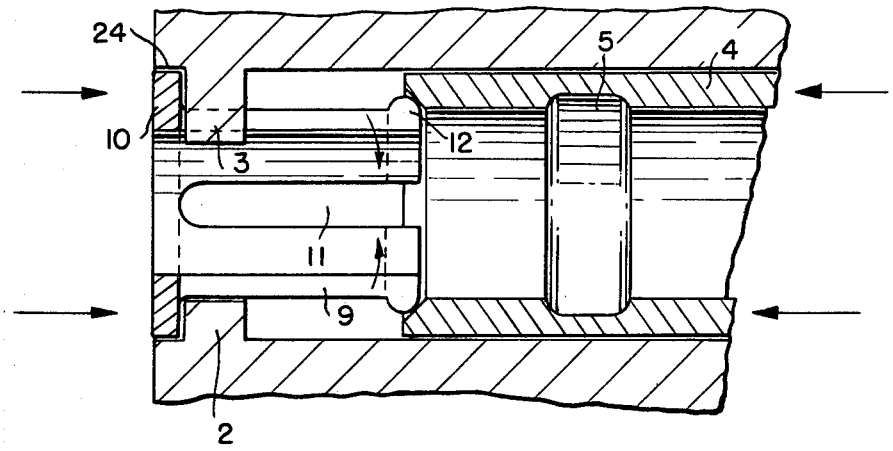
FIG. 4 is a sectional view showing the mounting step when the bushing permits the insertion of the cylinder axle thereinto.
Figure 5:
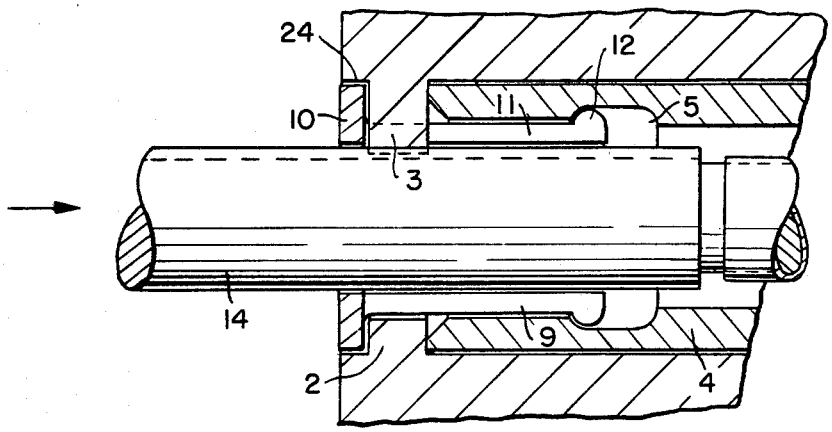
FIG. 5 is a sectional view illustrating the impossibility of dismounting the cylinder from the holder axle after the extractor has been inserted.
Figure 6:
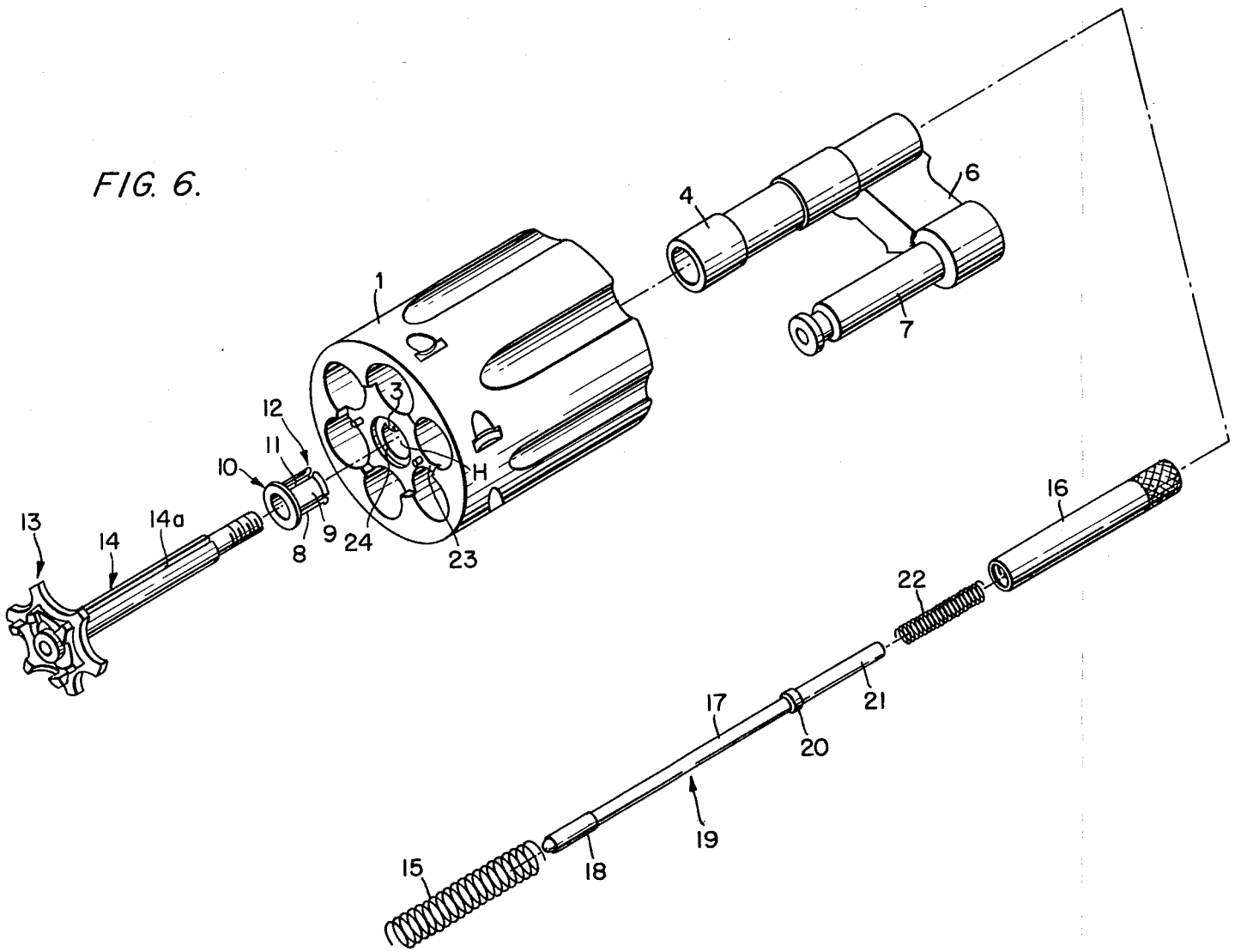
FIG. 6 is a fragmentary perspective view of the entire assembly.

The cylinder retaining means of the holder has as its main component, the bushing designated generally as 8 mounted on the cylinder 1. This bushing comprises a flange 10, an annular shoulder 12 and a cylindrical tubular body 9 divided by four longitudinal slots 11.

The bushing body has the same diameter as the cylindrical hole H existing at the rear face of the cylinder 1. This hole has a diameter less than the remainder of the cylinder bore B, in which the cylinder axle 4 is housed. The area of less diameter in the hole has, in the wall thereof, the extractor key projection 3 and operates as a stop 2 for the cylinder axle.

Due to the resiliency of the four fingers formed by segments of the cylindrical wall of the bushing, the bushing can be inserted with relatively small force into the hole of stop 2, overcoming the resistance presented by annular shoulder 12 of the bushing provided that one of the slots 11 thereof is aligned with key projection 3.

In view of the foregoing, once bushing 8 is inserted in the hole of stop 2, it is mounted in place until it is desired to remove it intentionally.

Once bushing 8 is placed in cylinder 1, it should be moved forwardly until flange 10 thereof is fully housed in the recess 24. By maintaining the bushing in this position, one can now mount the cylinder on the axle 4 of the holder 6. To this end, it is sufficient to introduce axle 4 into the central bore of the cylinder 1 and push it against bushing 8, until one hears a small click which indicates that the annular shoulder 12 of bushing 8 is engaged within the annular recess 5 of the cylinder axle.

Upon introducing extractor 14 through bushing 8 into the bore of axle 4, they cannot thereafter be disengaged because the extractor rod is of the same diameter as the bushing bore, the four fingers of which cannot deflect inwardly any further and the annular shoulder 12 is anchored in the annular recess 5 of the cylinder. To definitely assure that the cylinder 1 is held in its holder, it is sufficient to complete the assembly mounting with the successive introduction of extractor spring 15, the central rod 17, the spring 22 thereof and finally of the extractor sleeve 16 into the front hole in axle 4 of holder 6. The sleeve, after being introduced with the cylinder stationary, should be rotated in a counter-clockwise direction, and threaded on the end of the extractor rod 14 until it is well tightened.

In the assembly, mounted as above, cylinder 1 can rotate freely about its axle 4 but it is firmly anchored thereto, as to longitudinal movements. This allows the extraction of cartridges even in the most difficult cases, when it is frequently necessary to exert considerable force upon the extractor rod. Also forming part of the coaxial assembly disclosed above, are the central rod 17 pressed backwards by spring 22 which in turn is compressed between stop 20, and the abutment of the extractor sleeve 16. Thus, central rod 17 upon moving along the bore of extractor 14 causes the nose 18 of the rod to enter the frame bore, securing the cylinder thereto. Upon action on the revolver latch 25, this pushes nose 18 outwardly of the frame bore and simultaneously releases the extractor sleeve 16 from the lug 29 whereby the cylinder can tilt towards the left-hand side of the frame, by rotating about the holder axle 7. By pressing extractor sleeve 16 which is attached to the extractor rod 14, extractor star 13 moves away from the cylinder, thus extracting the cartridges. At the same time, extractor spring 15 is compressed against bushing 8. In all its movement, the extractor cannot rotate in relation to the cylinder, since the groove **14*a* existing in rod 14 is guided by key 3. Upon release of pressure on the sleeve 16, extractor spring 15 causes the extractor to return with the star 13** engaged in the cylinder.

For disconnecting the system, the precedure is reversed:

By securing cylinder 1 and rotating extractor sleeve 16 in a clock-wise direction, unscrewing it fully and removing it from the hole of the cylinder holder 6. This is also done for central rod 17, the spring 22 thereof and extractor spring 15.

By pulling extractor 14, until it is fully extracted from the bore of bushing 8, it is possible to disconnect the cylinder 1 from its axle 4. To this end, it is sufficient to slightly pull the cylinder and holder 6 in the opposite direction.

In the disclosure of the means for holding the cylinder on its related holder, those components of the gun not contributing specifically to the operation of the invention have not been referred.

Various modifications and changes of the invention can be made without departing from the scope thereof as defined in the following claims.

I claim:

1. In a firearm including a frame, a hammer mounted in the frame, a barrel, a cylinder opening between said hammer and said barrel, a bore in the wall of the cylinder opening beneath said hammer, a cylinder rotatably mounted in said opening and tiltably movable out of said opening for the loading and extraction of cartridges therefrom, said cylinder having a centrally disposed bore, a hollow cylinder axle telescopically fitted within said cylinder bore, a cartridge extraction mechanism, said mechanism including an extractor rod having an inner end and an outer end, a star shaped member at the outer end of said rod, the improvement comprising a resilient bushing fitted in that end of the cylinder bore adjacent said hammer, said end of the cylinder bore having a recess therein, said recess being of lesser diameter than the diameter of the remainder of the bore, a projection extending into said recess, means on said bushing cooperating with said projection to fix said bushing against rotation, retaining means on the inner wall of said cylinder axle, retaining means on the outer wall of said bushing, whereby when said cylinder axle is moved axially in said cylinder bore from the barrel end of said frame toward said hammer, said cylinder axle retaining means and said bushing retaining means engage with each other and connect the bushing to said cylinder axle.

2. A firearm according to claim 1 wherein, said bushing comprises a cylindrical body, having a flange at one end thereof, an annular shoulder at the other end thereof and a plurality of slots extending from the annular shoulder toward said flange, the means on said bushing cooperating with said projection comprising one of said slots.

3. A firearm according to claim 1 wherein, said retaining means on said bushing comprises an annular shoulder at one end thereof and the retaining means on the inner wall of said cylinder axle comprises an annular recess into which said shoulder fits.

4. A firearm according to claim 1 wherein, the inner end of said extractor rod is externally threaded and said rod has a groove extending longitudinally between said threaded end and said star, said projection engaging in said groove to prevent rotation of said extractor thereof.

5. A firearm according to claim 4 wherein, said cartridge extraction mechanism includes a sleeve having a threaded bore, spring means and a central rod each of which are partially housed in said sleeve, the threaded end of said sleeve connected to the threaded end of said extractor rod.

* * * * *